US005697330A

United States Patent [19]

Yetman et al.

[11] Patent Number: 5,697,330

[45] Date of Patent: Dec. 16, 1997

[54] POWER-VENTED, DIRECT-VENT WATER HEATER

[75] Inventors: Michael Edward Yetman, Richmond Hill; Maurice Jenson, Mississauga, both of Canada; Jacob H. Hall, Montgomery, Ala.

[73] Assignee: Rheem Manufacturing Company, New York, N.Y.

[21] Appl. No.: 416,081

[22] Filed: Apr. 4, 1995

[51] Int. Cl.[6] ..... F22B 5/00

[52] U.S. Cl. ..... 122/13.1; 122/14; 126/361

[58] Field of Search ..... 110/162; 126/361, 126/362; 122/13.1, 14, 16, 17, 18

[56] References Cited

U.S. PATENT DOCUMENTS

| | | | |
|---|---|---|---|
| 4,599,066 | 7/1986 | Granberg | 431/329 |
| 4,672,919 | 6/1987 | Staats | 122/13 R |
| 4,867,106 | 9/1989 | Staats | 122/13 R |
| 4,872,443 | 10/1989 | Ruark | 126/361 |
| 4,899,696 | 2/1990 | Kennedy et al. | 122/13 R |
| 5,012,793 | 5/1991 | Guzorek | 126/85 B |
| 5,020,512 | 6/1991 | Vago et al. | 126/350 R |
| 5,255,665 | 10/1993 | Windon | 126/389 |
| 5,355,841 | 10/1994 | Moore, Jr. et al. | 122/17 |

OTHER PUBLICATIONS

A.O. Smith "Sealed Shot" Sales Brocure p. (2)—1993.

*Primary Examiner*—Henry A. Bennett
*Assistant Examiner*—Gregory Wilson
*Attorney, Agent, or Firm*—Konneker & Smith

[57] ABSTRACT

A power vented water heater has a radiant gas burner located in a combustion chamber disposed beneath the storage tank portion of the water heater, and a draft inducer fan supported above the top end of the storage tank by a one piece molded plastic adapter fitting having a tubular body interconnecting the upper end of the water heater flue to the inlet of the fan, and a transverse outlet leg. A combustion gas discharge pipe is connected to the fan outlet, and an air intake pipe has a first portion connected to the outlet leg of the adapter fitting to deliver combustion gas cooling air thereto, and a second portion coupled to the burner inlet to deliver combustion air thereto along with gaseous fuel introduced into the second portion of the air intake pipe from an externally mounted gas valve. Integral orifice structures within the adapter fitting automatically maintain a predetermined ratio among the combustion gas, cooling air and combustion air flows. The operating pressure differential between the combustion discharge pipe and the first portion of the air intake pipe is sensed to monitor the structural integrity of the overall piping structure.

26 Claims, 5 Drawing Sheets

POWER-VENTED, DIRECT-VENT WATER HEATER

BACKGROUND OF THE INVENTION

The present invention generally relates to water heater apparatus and, in a preferred embodiment thereof, more particularly relates to an improved power-vented, direct-vent storage type water heater.

For many years fuel fired water heaters were manufactured and installed in "natural draft" configurations in which the hot products of combustion discharged from the water heater during its operation were permitted, via natural buoyancy of the heated combustion gases, to rise through a suitable vent pipe connected to a venting system, such as a chimney, adjacent the water heater. At the same time, ambient combustion air from the interior building space in which the water heater was installed was drawn into the water heater combustion system via suitable openings in the water heater structure.

While this relatively simple design has been widely accepted and utilized over the years, it has several disadvantages. For example, the positioning of a water heater of this conventional type within a given building is somewhat limited due to the necessity of positioning the water heater near a venting system. Additionally, the room air drawn into the water heater must be replaced by other air which, ultimately, is drawn into the building from the outside. This air entering the building from the outside, of course, must usually be heated or cooled as the case may be, thereby adding to the heating or air conditioning costs for the overall building as well as potentially drawing more outside pollutants into the interior building space.

One solution proposed to these various problems associated with natural draft water heaters that are supplied with inside combustion air has been to construct the water heaters in forced draft, direct-vent configurations. In this configuration, a draft inducer fan is placed in the water heater combustion gas flue to create an artificial draft therein, and outside air is directly ducted into the water heater for use as combustion air. Accordingly, due to the power venting provided by the draft inducer fan, the water heater does not need to be as near a conventional vent/chimney system, and no air is taken from the building interior for use as water heater combustion air.

Despite these advantages provided by forced draft, direct-vent water heaters of this general type, several problems, limitations and disadvantages are present in this type of water heater. For example, the use of a direct vented system tends to make heating and combustion component access more difficult. Additionally, the use of direct vented equipment tends to increase the fabrication cost of the water heater. Moreover, the combination of the direct vented configuration with the power venting structure tends to undesirably increase the overall complexity of the overall water heating system. In addition to these generally structural problems, forced draft direct vent type water heaters of the conventional type described above often have less than ideal levels of combustion efficiency and undesirably high levels of emitted pollutants such as Nox.

From the foregoing it can readily be seen that it would be highly desirable to provide an improved power-vented direct-vent water heater that eliminates, or at least substantially reduces, the above-mentioned problems, limitations and disadvantages commonly associated with conventional fuel fired water heaters of the type generally described above. It is accordingly an object of the present invention to provide such an improved power-vented direct-vent water heater.

SUMMARY OF THE INVENTION

In carrying out principles of the present invention, in accordance with a preferred embodiment thereof, a specially designed power-vented, direct-vent water heater is provided. The water heater basically comprises a storage tank adapted to hold a quantity of water to be heated and having top and bottom ends, inlet opening means for receiving water to be heated, and outlet means for discharging heated water. Wall means are provided for forming a combustion chamber disposed beneath the storage tank and upwardly bounded by its bottom end.

Fuel burner means are disposed in the combustion chamber and are operative to receive an air/fuel mixture from a source thereof, and burn the received air/fuel mixture to thereby heat water disposed in the storage tank. An exhaust flue extends vertically through the interior of the storage tank and is operative to receive and discharge hot combustion gas generated by the fuel burner means during operation thereof. The exhaust flue has a bottom end communicating with the interior of the combustion chamber, and a top end communicating with the exterior of the storage tank through its top end. A draft inducer fan is disposed above the top end of the storage tank and has an inlet communicated with the top end of the exhaust flue for receiving hot combustion gas therefrom, and an outlet for discharging the received combustion gas. Additionally, means are provided for supplying an air/fuel mixture to the fuel burner, and dilution air for mixture with and cooling of the hot combustion gas discharged from the exhaust flue, using a source of air remote from the water heater.

In accordance with various aspects of the present invention, the power-vented, direct-vent water heater, in an illustrated preferred embodiment thereof, is provided with several unique structural and operational features which, by themselves and in various combinations thereof, afford the water heater corresponding improvements over conventional waters of this general type.

According to one aspect of the invention, the inlet of the draft inducer fan is coupled to the top end of the exhaust flue using adapter means, interposed between the fan and the top end of the exhaust flue, for supporting the draft inducer fan, flowing hot combustion gas discharged from the exhaust flue into the fan inlet, and receiving a flow of cooling air from a source thereof for mixture with and cooling of hot combustion gas entering the fan inlet. The adapter means have integral first and second orifice means for respectively restricting the flow of combustion gas and cooling air into the interior thereof.

Representatively, the adapter means are defined by a one piece plastic molding having a tubular body portion interconnected between the top exhaust flue end and the fan inlet, and friction welded to the fan inlet side, and a transverse air intake leg portion. The first and second orifice means are formed in interior wall portions of the tubular body and its associated air intake leg portion.

According to other features of the invention, first piping means are connected to the draft inducer fan outlet and are operative to discharge combustion gas received by the fan from the exhaust flue, and second piping means are provided for receiving air from a location remote from the water heater and delivering the received air to the water heater. The second piping means have a first portion coupled to the draft inducer fan inlet to deliver combustion gas cooling air thereto, and a second portion extending into the combustion chamber and connected to the fuel burner means to deliver combustion air thereto.

Pressure sensing means are provided for sensing the operating pressure differential between the interiors of the first and second piping means and responsively generating an output signal that may be used to shut down the water heater when the sensed operating pressure differential is outside a predetermined acceptable operating pressure differential range. Preferably, means are also provided for sensing the combustion gas discharge temperature within the first piping means, and for sensing the inlet vacuum pressure of the draft inducer fan during operation thereof, and responsively generating output signals that may be used to shut down the water heater if (1) the sensed combustion gas discharge temperature is unacceptably high, or (2) the sensed fan inlet vacuum pressure is outside of an acceptable range thereof. Sensor means are also preferably provided for sensing the quality of combustion gas being generated during operation of the water heater and responsively generating an output signal indicative of an abnormal combustion condition such as a malfunction of the burner.

In accordance with another set of features of the invention, the fuel burner means are defined by a radiant type gas burner vacuum-formed from a ceramic material and horizontally offset from the bottom end of the exhaust flue within the combustion chamber to prevent flue scale from falling on the burner and potentially clogging outlet ports formed through its top side wall. A gas valve located externally of the combustion chamber has an orificed supply line that extends into the aforementioned second portion of the second piping means and discharges gaseous fuel thereinto for mixture with combustion air being drawn through the second piping means by the operation of the draft inducer fan. In this manner, only one penetration of the combustion chamber outer wall structure need be made to operatively deliver a fuel/air mixture directly to the burner. The discharge end of the gas valve supply line preferably has a diffuser thereon.

The water heater preferably includes a layer of insulation material that envelopes the storage tank and the wall means that form therewith the combustion chamber, and an outer metal jacket structure that extends outwardly around the insulation material.

Since there are no openings required in the outer wall structure of the combustion chamber to allow inflow thereto of ambient combustion air immediately adjacent the combustion chamber, conventional elevating support legs are not required on the lower end of the water heater. However, according to another feature of the invention, small spaced apart portions of the bottom end section of the outer jacket structure are downwardly deformed in a manner such that when the lower end of the water heater is placed on a floor or other horizontal support surface, the lower end of the water heater is slightly elevated relative thereto. This elevation is achieved without piercing the jacket structure to connect conventional support legs to the storage tank.

DETAILED DESCRIPTION

Figure 1:
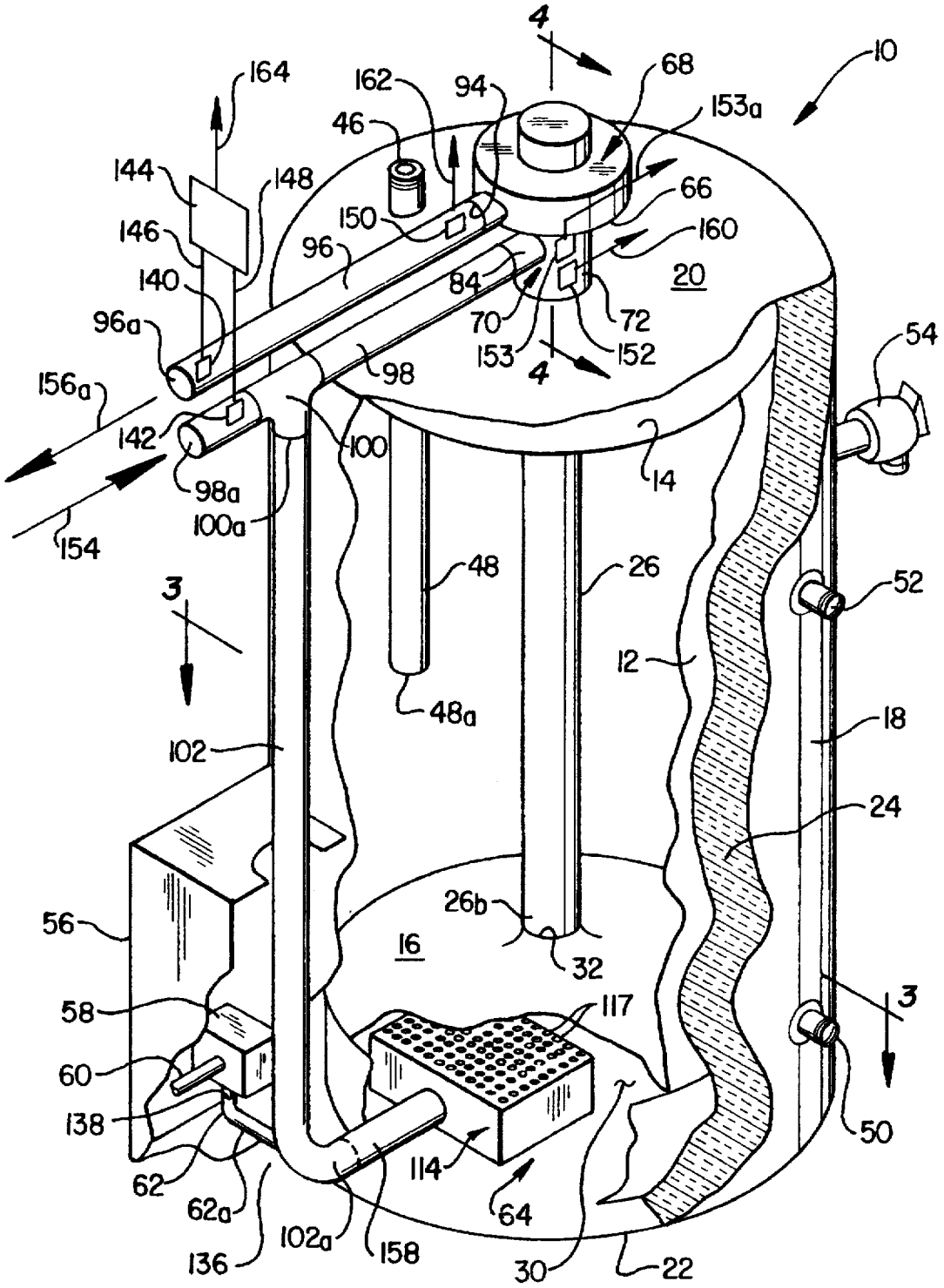
FIG. 1 is a partially cut away simplified perspective view of a power-vented, direct-vent water heater embodying principles of the present invention.

Referring initially to FIGS. 1–3 and 10, the present invention provides an fuel-fired, power-vented, direct-vent type water heater 10 that incorporates therein a variety of structural and operational improvements compared to conventional water heaters of this general type. Water heater 10 includes a vertically oriented cylindrical metal water storage tank 12 adapted to receive water to be heated and having upwardly domed top and bottom end walls 14 and 16. A cylindrical outer metal jacket structure 18 extends outwardly around the tank 12 and has top and bottom end walls 20 and 22. A suitable insulation material 24 is disposed in the cavity between the tank 12 and the outer jacket structure 18.

A vertically oriented tubular combustion product exhaust flue 26 having an elongated, laterally twisted baffle plate member 28 therein, is centrally disposed within the interior of the tank 12 and has an open upper end portion 26*a* extending upwardly through the upper tank and jacket ends 14, 20 (see FIG. 2) and a lower end portion 26*b* communicated with a burner chamber 30, disposed beneath the bottom tank end wall 16, via a central opening 32 in the bottom tank end wall 16. The bottom side of the burner chamber is defined by a horizontal metal plate member 34 (see FIG. 10). A layer of rigid insulation material 36 is sandwiched between the plate member 34 and the bottom jacket end wall 22.

An annular metal skirt member 38 depends from the periphery of the bottom tank end wall 16 and has a layer of rigid insulation material 40 disposed on its inner side surface and defining the vertical side boundary of the burner chamber 30. The top side of the burner chamber 30 is defined by the bottom side of the bottom tank end wall 16. To support the water heater 10 on a floor 42 or other horizontal surface, a spaced plurality of small support legs are formed on the bottom end of the water heater by downwardly dimpling the bottom jacket end wall 22 as at 44 (see FIG. 10) at spaced apart locations thereon. This fabrication technique is made possible due the subsequently described power-vented, direct-vent characteristics of the water heater 10, and permits support legs to be integrally formed on the water heater without piercing its jacket structure.

A pressurized supply water inlet fitting 46 (see FIG. 1) is positioned atop the upper jacket end wall 20 and connected to the top end of a dip tube 48 that extends down into the interior of the tank 12 and has an open lower end 48*a*. Also communicated with the interior of the tank, through its vertical side wall portion, are a drain fitting 50, a hot water outlet fitting 52, and a temperature and pressure relief valve 54 located as shown in FIG. 1. Upon a demand for heated water from the tank 12, heated water is flowed outwardly through the outlet fitting 52 and automatically replaced by pressurized supply water downwardly discharged into the tank 12 through the lower end of the dip tube 48.

Exteriorly mounted on a vertical side portion of the jacket structure 18 is a control cabinet 56 in which a gas supply valve 58 is operatively disposed. Gaseous fuel from a pressurized source thereof is supplied to the valve 58 via an inlet pipe 60, and the valve 58 is used to supply gaseous fuel, via a supply pipe 62, to a fuel burner 60 mounted in the burner chamber 30 as subsequently described herein.

Turning now to FIGS. 1, 2, 4 and 5, the upper end 26*a* of the flue 26 is operatively coupled to the inlet side 66 of a draft inducer fan 68 by a specially designed adapter fitting 70 representatively formed as a high strength plastic molding. The adapter fitting 70 has a vertically oriented tubular body portion 72 with an open lower exhaust inlet end 74 and an open upper discharge end 76 bordered by a radially outwardly projecting annular flange 78.

Disposed within the body 72 in an upwardly spaced relationship with its open lower end 74 is a transverse interior wall 80 with a central circular orifice opening 82 therein. Positioned vertically between the interior wall 80 and the upper end flange 78 is a transverse tubular cooling air intake leg portion 84 having a diameter smaller than that of the body 72 and an open outer end 86. A transverse interior wall 88 is disposed in the leg portion 84 inwardly adjacent the outer end 86 and has a circular orifice opening 90 therein.

The housing of the draft inducer fan 68, like the adapter fitting 70, is representatively formed from a high temperature plastic material, and the inlet side 66 of the fan 68 (see FIG. 4) is friction-welded to the top side of the adapter flange 78 in a manner positioning the fan housing inlet opening 92 within the periphery of the open upper adapter body end 76. The draft inducer fan 68 has a horizontally facing outlet 94. As best illustrated in FIG. 2, the lower end portion 74 of the adapter fitting 70 upwardly and sealingly receives the open upper end of the flue 26.

Figure 2:
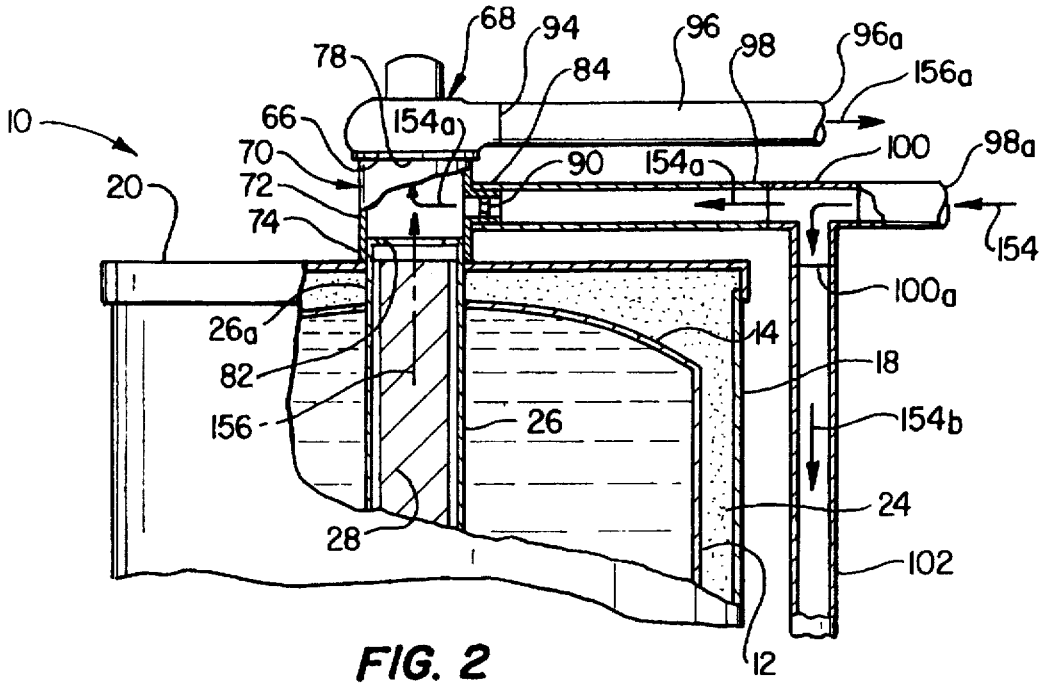
FIG. 2 is an enlarged scale, partially cut away side elevational view of an upper end portion of the water heater.

Referring now to FIGS. 1 and 2, a horizontally oriented tubular exhaust pipe section 96, representatively of a suitable plastic material, is connected at an inner end thereof to the fan outlet 94, and has an open outer end portion 96*a* which may be coupled to a suitable vent discharge conduit (not shown) that is extended to an outdoor vent fitting (also not shown). In a similar manner, a horizontally oriented air intake pipe 98 is representatively formed of a suitable plastic material and has an open inlet end portion 98*a* connectable to the inner end of an intake air conduit (not shown) secured at its outer end to an outdoor air intake structure (also not shown).

Figure 6:
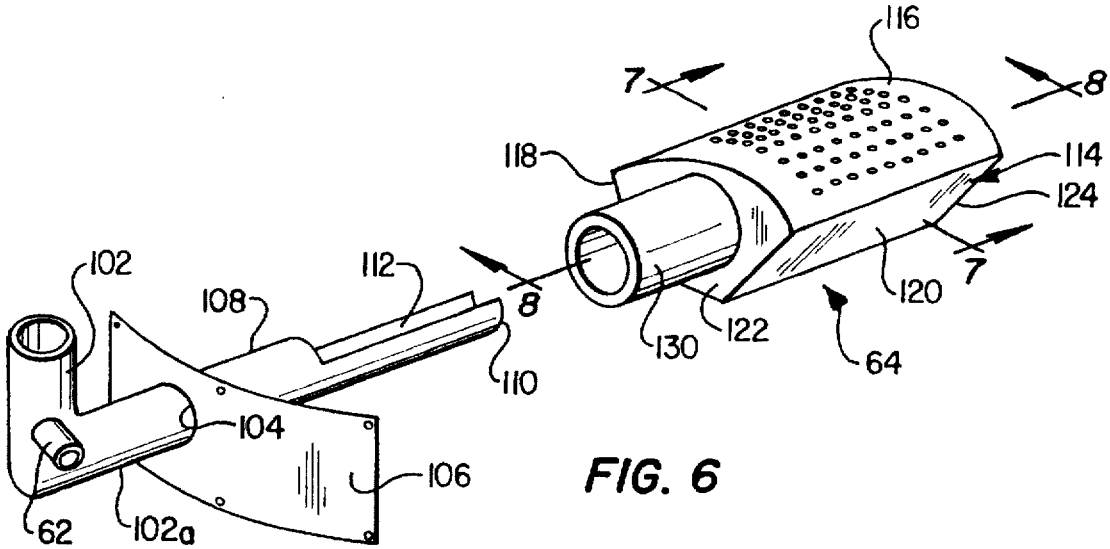
FIG. 6 is an exploded perspective view of a gas/air mixing manifold assembly and an associated vacuum formed ceramic burner used in the water heater.
Figure 9:
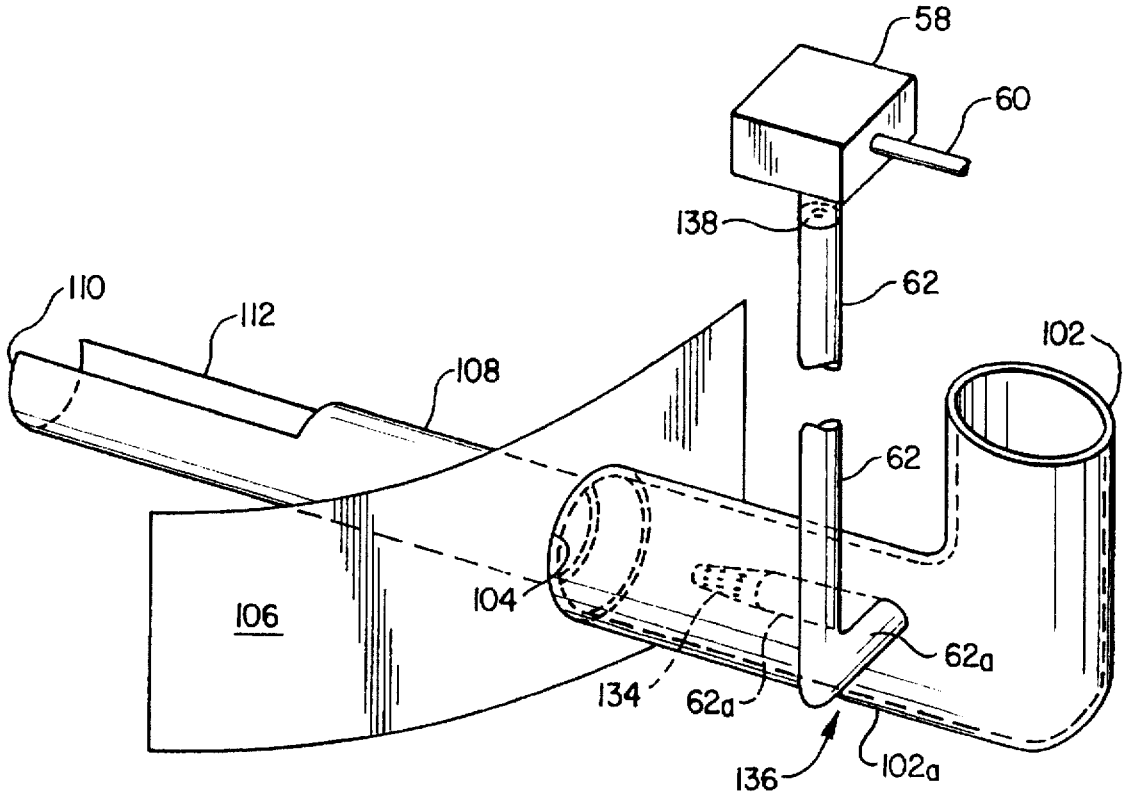
FIG. 9 is a simplified, partially schematic, enlarged scale perspective view of the gas/air mixing manifold assembly and an associated gas valve.
Figure 10:
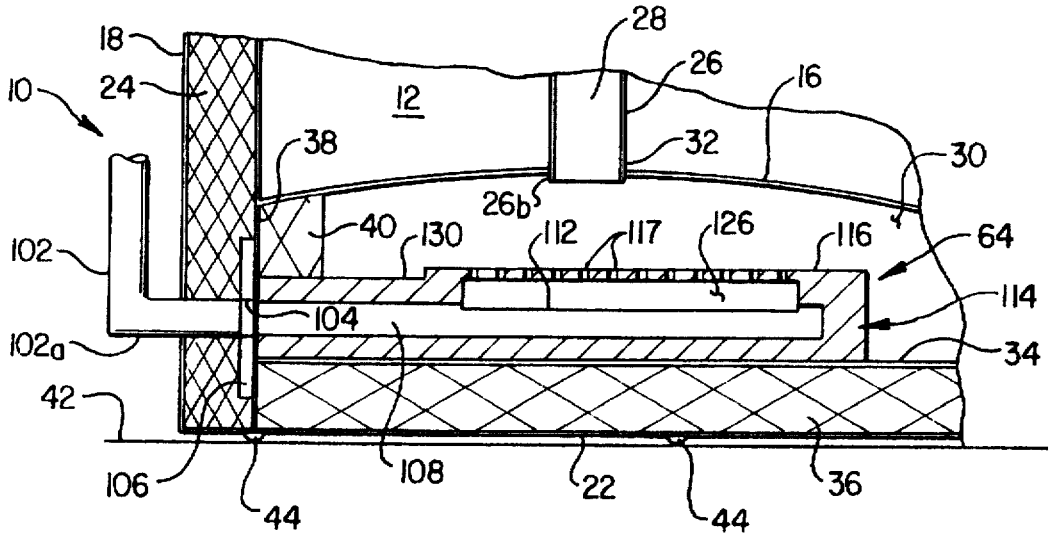
FIG. 10 is an enlarged scale cross-sectional view through a bottom end portion of the water heater taken along line 10—10 of FIG. 3.

A tee 100 is installed in the pipe 98 and has a downwardly facing leg portion 100*a* connected to the upper end of a vertically oriented combustion air intake pipe 102 extending outwardly adjacent the water heater jacket structure 18. A lower end portion 102*a* is bent horizontally inwardly toward the jacket structure 18 and, as best illustrated in FIGS. 6, 9 and 10, is sealingly received in a circular opening 104 in an arcuate metal burner window cover 106 operatively installed over a corresponding burner window area extending through the annular metal skirt member 38 horizontally extending around and bordering the combustion chamber 30. Referring now to FIGS. 6, 9 and 10, the open outer end portion of the intake pipe section 102*a* is coaxially and sealingly secured to a metal fuel/air mixture delivery tube 108 having an open outer end 110 and an open top side portion 112 extending axially inwardly from the open outer end 110.

Figure 3:
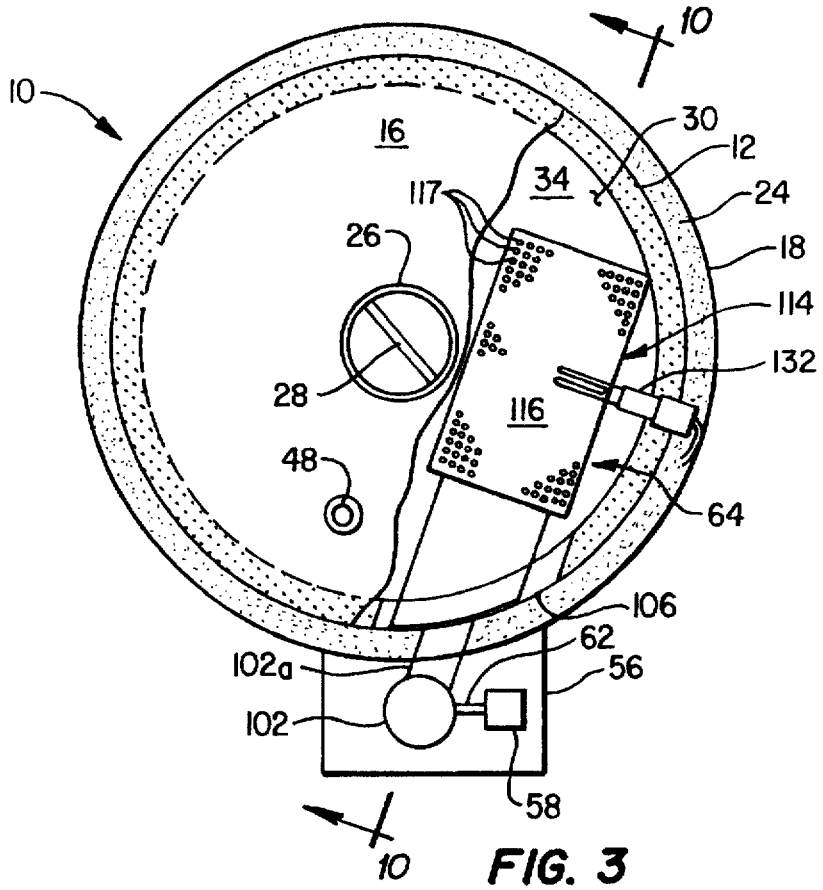
FIG. 3 is an enlarged scale, partially cut away cross-sectional view through the water heater taken generally along line 3—3 of FIG. 1.
Figure 4:
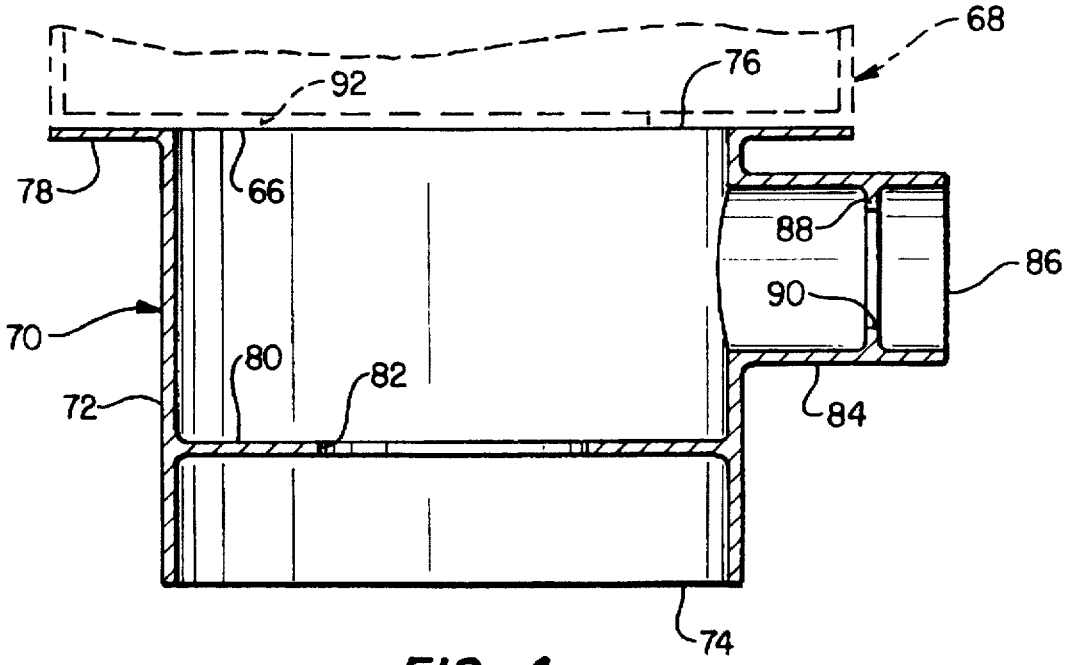
FIG. 4 is an enlarged scale cross-sectional view through a specially designed draft inducer fan connector structure taken generally along line 4—4 of FIG. 1.
Figure 5:
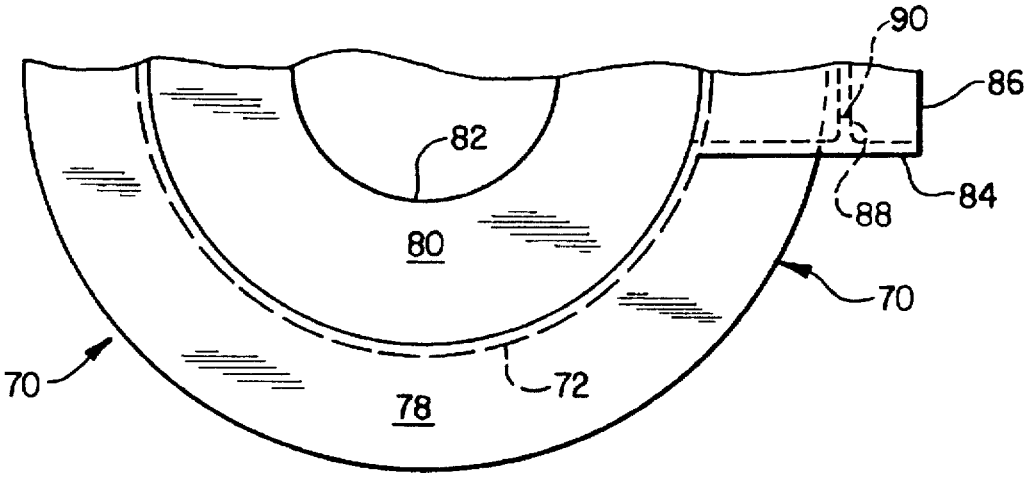
FIG. 5 is a partial top plan view of the connector structure shown in FIG. 4.
Figure 7:
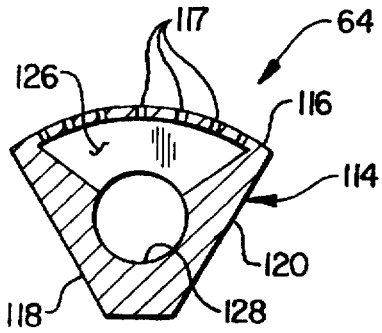
FIG. 7 is an enlarged scale cross-sectional view taken through the ceramic burner along line 7—7 of FIG. 6.
Figure 8:
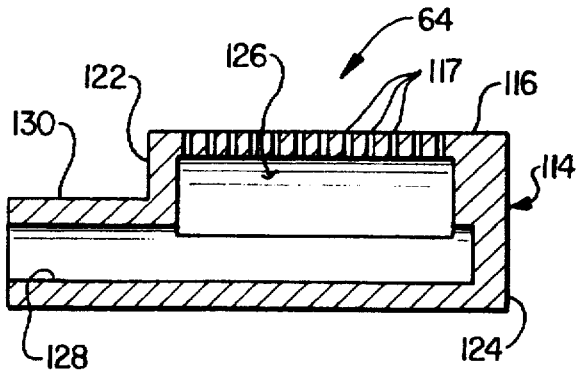
FIG. 8 is an enlarged scale cross-sectional view taken through the ceramic burner along line 8—8 of FIG. 6.

While the fuel burner 64 could be of a variety of types and configurations, it is preferably a radiant burner. As best illustrated in FIGS. 6–8, the burner 64 has a vacuum-formed hollow ceramic body 114 with an upwardly curved top side 116 having a mutually spaced series of discharge ports 117 formed therein, inwardly and downwardly sloped opposite vertical sides 118 and 120, front and rear ends 122 and 124, an interior chamber 126 having a partially circular portion 128, and a tubular inlet portion 130 axially projecting outwardly from the front end 122 of the burner body 114. Tubular inlet portion 130 slidingly and sealingly receives the fuel delivery tube 108 projecting inwardly from the burner window cover 106. As illustrated in FIG. 3, a conventional flame sensor/igniter device 132 projects into the burner chamber 30 and is positioned over the arcuate top side 116 of the burner body 114. For purposes later described, the burner 64 is horizontally offset from the lower end of the exhaust flue 26 as best illustrated in FIG. 3.

With reference now to FIG. 9, the gas supply pipe 62 extending downwardly from the bottom side of the gas valve 58 has a generally horizontal lower end portion 62*a* that passes transversely through the side wall of the lower air intake pipe end section 102*a* and then turns toward the water heater within the interior of the air intake pipe section 102*a*. At its outlet end the fuel supply pipe section 62*a* is operatively connected to a suitable supply diffuser fitting 134 disposed within the air intake pipe section 102*a*.

The pipe sections 62*a*, 102*a* and the supply diffuser 134 combinatively form a fuel/air supply manifold structure 136 disposed outwardly adjacent the burner chamber 30 and operative to mix received combustion air and gaseous fuel and deliver the mixed air and fuel to the burner 64 via the fuel delivery tube 108 which defines, in effect, an inward extension of the air pipe means 102*a*. A metering orifice 138 is operatively installed in the fuel supply pipe 62 adjacent the bottom side of the externally mounted gas valve 58.

Referring again to FIG. 1, for purposes later described, pressure sensors 140, 142 are respectively mounted in the outer end portions 96*a*, 98*a* of the exhaust pipe and air intake pipe sections 96, 98 and are respectively connected to a differential pressure sensor 144 by control lines 146, 148. Additionally, a temperature sensor 150 is installed in the exhaust pipe 96, a vacuum sensor 152, and a combustion gas quality sensor 153 are installed in the body portion 72 of the adapter fitting 70.

During firing of the water heater 10, the draft inducer fan 68 (see FIGS. 1 and 2) is running while pressurized gaseous fuel is being delivered to the interior of the air intake pipe section 102*a* (see FIGS. 1 and 9) via the orificed gas supply line 62*a* and its associated supply diffuser 134 in the interior of the air intake pipe section 102*a*. Operation of the fan 68 draws outside air 154 (see FIGS. 1 and 2) inwardly through the outer end portion 98*a* of the air intake pipe section 98 while hot combustion gas 156 from the burner 64 is being drawn upwardly through the internally baffled flue 26 by the fan 68.

A first portion 154*a* of the incoming outside air 154 is drawn into the adapter body 72, through its leg portion 84, and used to cool the hot combustion gas 156 also entering the adapter body. The cooled combustion gas 156*a* is discharged through the exhaust pipe section 96. The balance 154*b* of the incoming outside air 154 is drawn downwardly through the vertical air inlet pipe 102 and used as combustion air for the burner 64. This combustion air is mixed with the gaseous fuel discharged from the diffuser 134 in the fuel/air supply manifold structure 136 (see FIG. 9) and delivered therewith into the interior of the burner body 114 and then discharged through the burner body ports 117 for combustion along the top side of the radiant burner as previously initiated by the igniter 132 (see FIG. 3).

The various specially designed structural and operational features incorporated in the water heater 10 provide it with several distinct advantages over conventional power-vented, direct-vent water heaters. For example, the built-in orifice openings 82 and 90 in the one piece molded plastic adapter fitting 70 shown in FIGS. 1, 2, 4 and 5 serve to automatically maintain predetermined flow quantity relationships among the combustion gas flow 156, the cooling or "dilution" air flow 154*a* and the combustion air flow 154*b*. Additionally, the adapter fitting 70 serves as a convenient mounting structure for the draft inducer fan 68 which is representatively friction welded to the top end flange 78 of the adapter fitting 68.

The use of the radiant fuel burner 64 (see FIGS. 1, 3, 6 and 10) provides good fuel efficiency and at the same time yields lowered Nox emissions during water firing. The horizontal offsetting of the burner 64 from the bottom end of the flue 26 prevents flue scale from falling on the top side 116 of the burner and potentially clogging its discharge ports 117. Thus, the need to provide for periodic access to the burner is substantially eliminated. The need for access to the interior of the chamber 30 is further reduced by the placement of the fuel metering orifice 138 (see FIGS. 1 and 9) at the gas valve 58 externally of the water heater interior.

According to another aspect of the invention, the mixing of the fuel and combustion air externally of the water heater body permits both the fuel and air to be delivered to the burner using only a single penetration in the side of the water heater body assembly—namely, the penetration 158 (see FIG. 1) through which the air intake pipe section 102*a* enters the burner chamber 30. This pipe section 102*a*, as illustrated in FIG. 9, has disposed therein the outlet end portion 62*a* of the gaseous fuel supply pipe 62.

Because of the direct-vent nature of the water heater 10, no other intake air penetrations of the overall water heater body structure are required, and the ambient interior space air around the water heater need not be used for combustion air or otherwise disturbed during firing of the water heater. Because no ambient indoor air around the water heater is needed for combustion air, the water heater 10 does not need separate support legs to elevate it a substantial distance off the floor 42 (see FIG. 10). This permits the economical use of the small support projections 44 formed integrally with the bottom jacket end wall, a provision of off-the-floor elevating structures that do not require puncturing of the outer wall structure of the water heater. Moreover, the use of the exhaust and intake piping structure 96, 98, 102 incorporated in the overall water heater assembly, provides for easy installation of the water heater in the field.

The present invention also provides for improved operational control of the water heater 10. For example, with reference to FIG. 1, the vacuum sensor 152 disposed in the adapter fitting body 72 is operative to sense the negative pressure created therein during operation of the draft inducer fan 68. If this negative operational pressure is not within a predetermined range, the sensor 152 automatically generates an output signal 160 which is used to shut the water heater 10 down until the problem is investigated and remedied. In a similar fashion the temperature sensor 150 monitors the temperature of the cooled combustion gas 156*a* being discharged from the water during firing thereof. If the temperature of the cooled combustion gas 156*a* is unacceptably high, the temperature sensor 150 responsively generates an output signal 162 that is used to shut the water heater down. Sensor 153 is used to sense the quality of the combustion gas upwardly traversing the adapter fitting body 72 during firing of the water heater and responsively generating an output signal 153*a*, which may be used to shut the water heater down, if an abnormal combustion condition (for example, a malfunction or breakage of the burner) is sensed.

The pressure sensors 140, 142 and the differential pressure switch 144 are used to monitor the structural integrity of the discharge and intake piping structure 96, 98, 102. Specifically, there is a normal range in the pressure differential between the interiors of the piping sections 96*a*, 98*a* during firing of the water heater 10 with the piping sections 96, 98, 102 intact. However, if one of these piping sections (for example, the vertical piping section 102) becomes broken or obstructed, the pressure differential monitored by the differential pressure sensor 144 is taken out of the acceptable pressure differential range. This causes the pressure differential sensor to automatically generate an output signal 164 that is used to shut down the water heater 10.

The foregoing detailed description is to be clearly understood as being given by way of illustration and example only, the spirit and scope of the present invention being limited solely by the appended claims.

What is claimed is:

1. A water heater comprising:

a storage tank adapted to hold a quantity of water to be heated and having top and bottom ends, inlet opening means for receiving water to be heated, and outlet means for discharging heated water;

wall means for forming a combustion chamber disposed beneath said storage tank;

fuel burner means disposed in said combustion chamber and operative to receive an air/fuel mixture from a source thereof, burn the received air/fuel mixture to thereby heat water disposed in said storage tank;

an exhaust flue vertically extending through the interior of said storage tank and operative to receive and discharge hot combustion gas generated by said fuel burner means during operation thereof, said exhaust flue having a bottom end communicating with the interior of said combustion chamber, and a top end communicating with the exterior of said storage tank through said top end thereof;

a draft inducer fan disposed above said top end of said storage tank and having an inlet and an outlet; and adapter means, interposed between said draft inducer fan and said top end of said storage tank, for supporting said draft inducer fan, flowing hot combustion gas discharged from said exhaust flue into said inlet of said draft inducer fan, and receiving a flow of cooling air from a source thereof for mixture with and cooling of hot combustion gas entering said inlet of said draft inducer fan, said adapter means being of a unitary construction and having integral first and second orifice means for respectively restricting the flow of combustion gas and cooling air into the interior thereof, said adapter means having a vertically oriented tubular body portion with a tubular leg portion horizontally extending outwardly from an axially intermediate portion thereof, said first orifice means including a first transverse interior wall disposed within a lower end portion of said tubular body portion and having a first opening therein, and said second orifice means including a second transverse interior wall disposed in said tubular leg portion and having a second opening therein.

2. The water heater of claim 1 wherein:

said adapter means are defined by a one piece plastic molding.

3. The water heater of claim 1 wherein:

said draft inducer fan has an inlet side wall, and said adapter means have a tubular body portion having a lower end telescopingly engaged with a top end portion of said exhaust flue, and an upper end secured to said inlet side wall of said draft inducer fan.

4. The water heater of claim 3 wherein:

said tubular body portion of said adapter means has an annular flange at the upper end thereof, and said inlet side wall of said draft inducer fan is friction welded to said annular flange.

5. A water heater comprising:

a storage tank adapted to hold a quantity of water to be heated and having top and bottom ends, inlet opening means for receiving water to be heated, and outlet means for discharging heated water;

wall means for forming a combustion chamber disposed beneath said storage tank;

fuel burner means disposed in said combustion chamber and operative to receive an air/fuel mixture from a source thereof, burn the received air/fuel mixture to thereby heat water disposed in said storage tank;

an exhaust flue vertically extending through the interior of said storage tank and operative to receive and discharge hot combustion gas generated by said fuel burner means during operation thereof, said exhaust flue having a bottom end communicating with the interior of said combustion chamber, and a top end communicating with the exterior of said storage tank through said top end thereof;

a draft inducer fan disposed above said top end of said storage tank, said draft inducer fan having an inlet communicated with an upper end portion of said exhaust flue, and an outlet;

first piping means, connected to said draft inducer fan outlet, for discharging combustion gas received by said draft inducer fan from said exhaust flue;

second piping means for receiving air from a location remote from said water heater and delivering the received air to said water heater, said second piping means having a first portion coupled to said draft inducer fan inlet to deliver combustion gas cooling air thereto, and a second portion extending into said combustion chamber and connected to said fuel burner means to deliver combustion air thereto; and pressure sensing means for sensing the operating pressure differential between the interiors of said first and second piping means and responsively generating an output signal that may be used to shut down said water heater when the sensed operating pressure differential is outside a predetermined acceptable operating pressure differential range.

6. The water heater of claim 5 further comprising:

means for sensing the combustion gas discharge temperature within said first piping means and responsively generating an output signal that may be used to shut down said water heater when the sensed combustion gas discharge temperature is greater than a predetermined permissible magnitude thereof.

7. The water heater of claim 6 further comprising:

means for sensing the inlet vacuum pressure of said draft inducer fan during operation thereof and responsively generating an output signal that may be used to shut down said water heater when the sensed inlet vacuum pressure deviates from a predetermined acceptable range thereof.

8. A water heater comprising:

a storage tank adapted to hold a quantity of water to be heated and having top and bottom ends, inlet opening means for receiving water to be heated, and outlet means for discharging heated water;

wall means for forming a combustion chamber disposed beneath said storage tank;

fuel burner means disposed in said combustion chamber and operative to receive a air/fuel mixture from a source thereof, burn the received air/fuel mixture to thereby heat water disposed in said storage tank, said fuel burner means having an inlet for receiving the air/fuel mixture;

an exhaust flue vertically extending through the interior of said storage tank and operative to receive and discharge hot combustion gas generated by said fuel burner means during operation thereof, said exhaust flue having a bottom end communicating with the interior of said combustion chamber, and a top end communicating with the exterior of said storage tank through said top end thereof;

a draft inducer fan disposed above said top end of said storage tank and having an inlet communicated with an upper end portion of said exhaust flue, and an outlet;

air pipe means for flowing combustion air into said fuel burner means inlet, said air pipe means having a portion disposed externally of said combustion chamber, and a portion extending into said combustion chamber and connected to said fuel burner means inlet;

a gas valve disposed externally of said combustion chamber and adapted to receive gaseous fuel from a pressurized source thereof, said gas valve having an outlet supply pipe extending therefrom into the interior of said portion of said air pipe means disposed externally of said combustion chamber, said outlet supply pipe being operative to discharge gaseous fuel into the interior of said portion of said air pipe means for mixture therein with combustion air being delivered therethrough to said fuel burner means.

9. The water heater of claim 8 further comprising:

a metering orifice installed in said outlet supply pipe adjacent said gas valve.

10. The water heater of claim 8 wherein:

said fuel burner means is a radiant gas burner.

11. The water heater of claim 10 wherein:

said radiant gas burner is of a vacuum-formed ceramic construction.

12. The water heater of claim 10 wherein:

said radiant gas burner is horizontally offset from said bottom end of said exhaust flue.

13. The water heater of claim 8 wherein:

said water heater further comprises a layer of insulation material enveloping said storage tank and said wall means, and a metal jacket structure extending outwardly around said layer of insulation material, said metal jacket structure including a bottom end portion having a spaced plurality of downwardly deformed sections serving as elevating support means for elevating the balance of said bottom end portion above a horizontal support surface upon which said water heater is placed.

14. A power-vented, direct-vent water heater comprising:

a storage tank adapted to hold a quantity of water to be heated and having top and bottom ends, inlet opening means for receiving water to be heated, and outlet means for discharging heated water;

wall means for forming a combustion chamber disposed beneath said storage tank;

a radiant type gas burner disposed in said combustion chamber and operative to receive an air/gaseous fuel mixture from a source thereof, said radiant type gas burner having an inlet portion for receiving the air/gaseous fuel mixture;

an exhaust flue vertically extending through the interior of said storage tank and operative to receive and discharge hot combustion gas generated by said radiant type gas burner during operation thereof, said exhaust flue having a bottom end communicating with the interior of said combustion chamber, and a top end communicating with the exterior of said storage tank through said top end thereof;

a draft inducer fan disposed above said top end of said storage tank and having an inlet and an outlet;

an adapter fitting having a vertically oriented tubular body portion with a tubular leg portion horizontally extending outwardly from an axially intermediate portion thereof, said body portion having a lower end connected to said top end of said exhaust flue to receive hot combustion gas discharged therefrom, and an upper end communicated with said inlet of said draft inducer fan, said body portion further having an interior wall extending transversely across a lower end portion of said body portion and having a central opening formed therein, said tubular leg portion having an interior wall extending transversely therethrough and having a central opening therein;

air intake piping means for receiving air from a location remote from said water heater and delivering the received air to said water heater, said air intake piping means having a first portion disposed externally of said storage tank and connected to said tubular leg portion of said adapter fitting for delivering cooling air thereto for mixture with hot combustion gas entering said tubular body portion of said adapter fitting, and a second portion disposed externally of said storage tank and having a first end connected to said first air intake piping means portion, and a second end communicated with said burner inlet, for delivering combustion air to said burner; and a gas valve disposed externally of said combustion chamber and adapted to receive gaseous fuel from a pressurized source thereof, said gas valve having an outlet supply pipe extending therefrom into the interior of said second air intake piping means portion, said outlet supply pipe being operative to discharge gaseous fuel into the interior of said second air intake piping means portion for mixture therein with combustion being delivered therethrough to said burner.

15. The power-vented, direct-vent water heater of claim 14 wherein:

said adapter fitting is a one piece plastic molding.

16. The power-vented, direct-vent water heater of claim 14 wherein:

said draft inducer fan has an inlet side wall, and said lower end of said adapter fitting tubular body portion is telescopingly engaged with said top end of said exhaust flue, and said upper end of said adapter fitting tubular body portion is secured to said draft inducer fan inlet side wall.

17. The power-vented, direct-vent water heater of claim 16 wherein:

said upper end of said adapter fitting tubular body portion has an annular external flange thereon, and said inlet side wall of said draft inducer fan is friction welded to said annular flange.

18. The power-vented, direct-vent water heater of claim 14 further comprising:

an elongated, laterally twisted baffle member longitudinally received and supported within said exhaust flue.

19. The power-vented, direct-vent water heater of claim 14 further comprising:

combustion gas discharge piping means connected to said draft inducer fan outlet and operative to receive and discharge combustion gas exiting said draft inducer fan outlet, and pressure sensing means for sensing the operating pressure differential between the interiors of said combustion gas discharge piping means and said first portion of said air intake piping means and responsively generating an output signal that may be used to shut down said water heater when the sensed operating pressure differential is outside a predetermined acceptable operating pressure differential range.

20. The power-vented, direct-vent water heater of claim 19 further comprising:

means for sensing the temperature within said combustion gas discharge piping means and responsively generating an output signal that may be used to shut down said water heater when the sensed combustion gas discharge temperature is greater than a predetermined permissible magnitude thereof, and means for sensing the inlet vacuum pressure of said draft inducer fan during operation thereof and responsively generating an output signal that may be used to shut down said water heater when the sensed inlet vacuum pressure deviates from a predetermined acceptable range thereof.

21. The power-vented, direct-vent water heater of claim 14 further comprising:

a metering orifice installed in said outlet supply pipe adjacent said gas valve.

22. The power-vented, direct-vent water heater of claim 14 wherein:

said radiant type gas burner is of a ceramic construction.

23. The power-vented, direct-vent water heater of claim 14 wherein:

said radiant type gas burner is horizontally offset from said bottom end of said exhaust flue.

24. The power-vented, direct-vent water heater of claim 14 wherein:

said water heater further comprises a layer of insulation material enveloping said storage tank and said wall means, and a metal jacket structure extending outwardly around said layer of insulation material, said metal jacket structure including a bottom end portion having a spaced plurality of downwardly deformed sections serving as elevating support means for elevating the balance of said bottom end portion above a horizontal support surface upon which said water heater is placed.

25. The water heater of claim 8 wherein:

said gas valve outlet supply pipe has an outlet end diffuser mounted thereon and operative to diffuse gaseous fuel discharged therefrom into the interior of said portion of said air pipe means.

26. The water heater of claim 5 further comprising:

means for sensing the quality of combustion gas being generated during operation of said water heater and responsively generating an output signal indicative of a sensed abnormal combustion condition such as a malfunction of said fuel burner means.

* * * * *